US005374120A

United States Patent [19]

Possanza et al.

[11] Patent Number: 5,374,120

[45] Date of Patent: Dec. 20, 1994

[54] MODIFIED PASSIVE LIQUID IN-LINE SEGMENTED BLENDER

[75] Inventors: Steven D. Possanza, Penfield; Thomas K. Winkler, Fairport; Kenneth R. Kresinske, Webster, all of N.Y.

[73] Assignee: Eastman Kodak Company, Rochester, N.Y.

[21] Appl. No.: 163,245

[22] Filed: Dec. 6, 1993

[51] Int. Cl.[5] ..... B01F 15/06; F27B 14/00

[52] U.S. Cl. ..... 366/144; 366/314; 126/343.5 A; 219/421; 222/146.2; 432/161

[58] Field of Search ..... 366/144, 145, 146, 147, 366/181, 205, 314, 341, 113; 126/343.5 R, 343.5 A, 284; 219/421; 432/160, 161; 137/341; 222/1, 146.2, 146.4, 146.5

[56] References Cited

U.S. PATENT DOCUMENTS

| | | | |
|---|---|---|---|
| 180,688 | 8/1876 | Whitaker | 126/343.5 A |
| 328,714 | 10/1885 | Ralston | 126/343.5 A |
| 2,217,743 | 10/1940 | Greenewalt | 219/421 X |
| 2,253,176 | 8/1941 | Graves | 126/343.5 A |
| 2,683,073 | 7/1954 | Pierce | 219/421 X |
| 2,872,296 | 2/1959 | Lemon et al. | 23/283 |
| 3,032,635 | 5/1962 | Kraft | 126/343.5 A X |
| 3,042,481 | 7/1962 | Coggeshall | 126/343.5 A X |
| 3,178,067 | 4/1965 | Bell et al. | 222/146.5 |
| 3,369,874 | 2/1968 | Wilhelm | 23/309 |
| 3,810,778 | 5/1974 | Wang . | |
| 3,847,616 | 11/1974 | Kaneko et al. | 96/94 |
| 3,900,326 | 8/1975 | Herzhoff et al. | 96/114.8 |
| 3,904,392 | 9/1975 | VanIngen et al. | 366/113 X |
| 4,070,167 | 1/1978 | Barbee et al. | 55/192 |
| 4,379,836 | 4/1983 | Schnoring et al. | 430/377 |
| 4,844,927 | 7/1989 | Morris, II et al. | 219/421 X |
| 5,045,445 | 9/1991 | Schultz | 430/642 |
| 5,182,190 | 1/1993 | LeFaou et al. | 430/546 |

FOREIGN PATENT DOCUMENTS

| | | |
|---|---|---|
| 1501515 | 2/1978 | United Kingdom . |
| 2052730 | 1/1981 | United Kingdom . |
| WO89/06829 | 7/1989 | WIPO . |
| WO92/09007 | 5/1992 | WIPO . |

*Primary Examiner*—David A. Scherbel
*Assistant Examiner*—Charles Cooley
*Attorney, Agent, or Firm*—Carl A. Ruoff

[57] ABSTRACT

A liquefying apparatus for melting and blending solid materials includes a hopper with a coiled heating element disposed therein which supports and melts the solid materials into liquid form. The hopper is segmented into a plurality of compartments and as the solid material melts the liquid is collected in the lower portion of the hopper. The collected liquid is continuously agitated to ensure that there are no concentration pockets. The lower section is also provided with a deaeration device to prevent entrained air from entering the liquid.

4 Claims, 2 Drawing Sheets

MODIFIED PASSIVE LIQUID IN-LINE SEGMENTED BLENDER

FIELD OF THE INVENTION

The present invention relates to an apparatus and method for liquefying solid materials. More particularly, the present invention relates to an on demand in-line liquefier which blends and liquefies multiple batches of solid chunks of aqueous gelatin emulsions.

BACKGROUND OF THE INVENTION

Typical emulsion coating operations require liquid kettle blending to smooth batch-to-batch emulsion variability during long coating events. Conventional continuous liquefaction technology requires quick chilling, and/or pelletization, and solid blending equipment to pre-blend the emulsion in solid form. This technology is described in U.S. Pat. No. 5,182,190.

In U.S. patent application Ser. No. 07/815,462, a modified passive liquefaction system is described. In this system, a liquefying apparatus having a hopper which includes an upper and lower section is described. The upper section is adapted to receive a meltable solid material and has a coiled tube disposed therein. The coil tube supports, melts and passes the melted solid material therethrough such that the liquefied product is stored in the lower section of the hopper and subsequently drawn off. Use of this technology with U.S. Pat. No. 5,182,190 allows one to first blend the solid material, and then passively liquefy the gelled material.

The present invention is a method which allows one to mix and blend solid gelled chunk material in the same operation, thereby eliminating solid blending equipment and increasing productivity of the operation.

SUMMARY OF THE INVENTION

The present invention is an apparatus and method for processing a plurality of meltable solid components. The invention includes a hopper having an upper section for receiving the plurality of meltable solid components, the upper section being divided into a plurality of compartments by walls. The hopper also includes a lower section for storing the melted components. A coiled tube is disposed at the cross section of the hopper for supporting and melting the meltable solid components. The cross section has a coiled tube surface area. The plurality of compartments divides the cross section into a plurality of compartment coiled surface areas. The rate of melting of each of the plurality of components is proportional to the overall melting rate based on the compartment coiled surface area and the coiled tube surface area. A mixer is disposed in the lower section for agitating the liquid at a rate which minimizes air entrainment. Liquid removal means are provided for removing the liquid from the lower section. Heating means is also supplied for supplying heat to the coiled tube for melting the plurality of solid components.

For a better understanding of the present invention together with other objects, advantages and capabilities thereof, reference is made to the following description and appended claims in connection with the above described drawings.

DESCRIPTION OF THE PREFERRED EMBODIMENT

Figure 1:
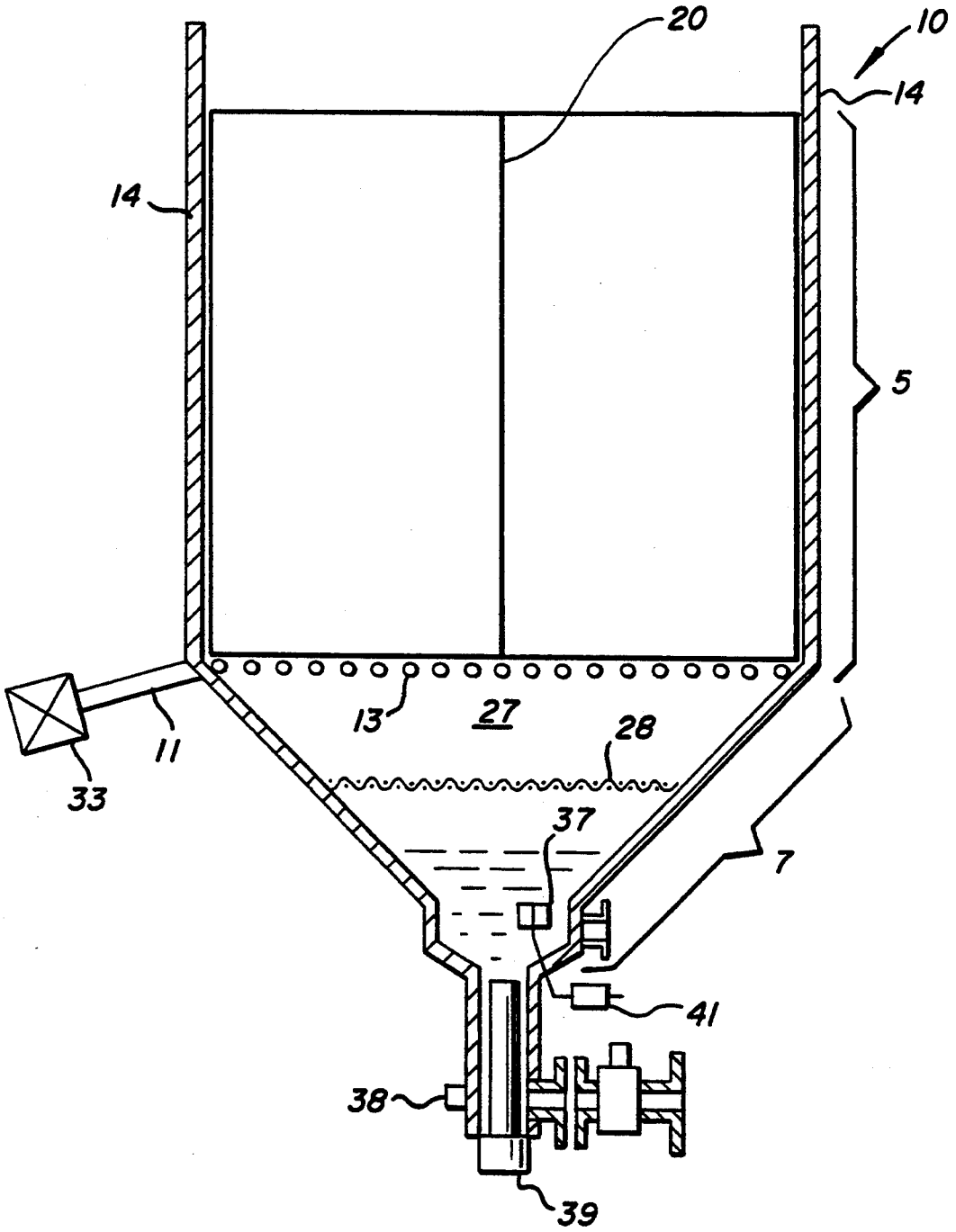
FIG. 1 shows a sectional view of the segmented passive liquefier of the present invention.
Figure 2:
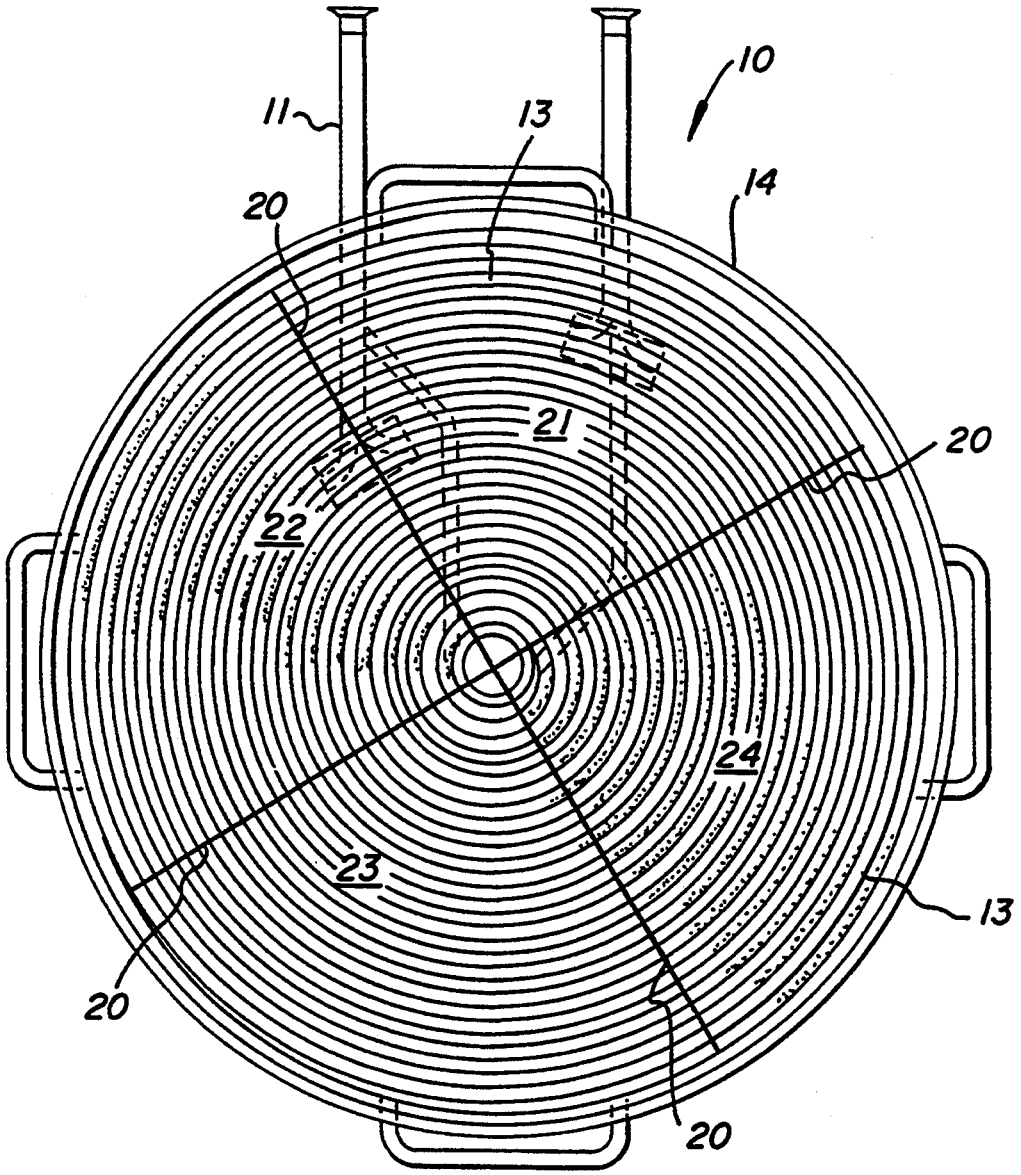
FIG. 2 shows a top view of the segmented passive liquefier of the present invention showing four compartments.

Referring to FIGS. 1 and 2 a segmented passive liquefier is shown which includes a hopper 10 having a heating coil 13 which is disposed therein and connected to the hopper 10 in a conventional manner. Hopper 10 is generally divided into an upper section 5 in which the coil 13 is disposed and a lower section 7. The coil 13 supports solid materials, such as solid chunks of aqueous gelatin, which are fed into the hopper 10. The solid materials rest on the coil 13 until they are heated by the coil 13 and transformed into a liquid state. Additionally, the upper section 5 includes straight vertical walls 14 which prevent the solid chunks of aqueous gelatin from adhering to the wall surface which can occur when the walls of the hopper 10 are in a slanted configuration.

Disposed in the upper section of hopper 10 are dividers 20 which form a plurality of compartments, 21, 22, 23, 24 in the upper section as shown in FIG. 2. Although four compartments are shogun in FIG. 2, the upper section of the hopper can be divided into any number of compartments, depending on the number of batches of Welled chunk material to be mixed.

Coil 13 is connected by inlet pipe 11 and valve 33 which is connected to a hot water supply. When the valve 33 is opened hot water is pumped through the coil 13 which provides the heat to melt the gelatin.

The liquefied gelatin forms drops which fall between the coil 13 through an air space 27 and is collected in the lower portion of the hopper. It is possible to dispose within the air space 27, a screen 28 which collects any solid chunks of gelatin or any foreign objects which might pass through the coil 13. The screen 28 is removable such that during periodic maintenance it can be removed and cleaned.

Solid gelatin material, in particular, photographic emulsion, is added to the segmented hopper located on top of the coil 13. The overall melting rate of the material in all compartments is controlled by the volume and temperature of hot water diverted through the coil 13. The melting rate of the material in the individual compartments 21, 22, 23, 24 is proportional to the overall rate based on the coil surface area within the individual compartment. In a typical application, the hopper is divided into four equal compartments to provide four compartments for blending four batches of material. The relative rates of the melting with this configuration are within 2.2% relative standard deviations.

In the lower portion 7 of the hopper 10 mixer 37 is attached to some type of motor 41. The mixer 37 prevents concentration pockets from forming in the liquefied gelatin. The mixer 37 agitates the liquefied gelatin at a rate such that air entrainment is minimized. Also disposed in the lower section of 7 of the hopper 10 is a liquid level sensor 38 and debubbling device 39. The liquid level sensor can be any conventional type such as an in-line pressure sensor. The debubbling device can be the type described in U.S. Pat. No 4,070,167.

The rate of melting gelatin is controlled to be equal to the rate of removal of the liquefied gelatin by controlling the temperature and rate of the hot water supplied to the coil. In the present invention there is no specific limitation to the number of compartments or the relative area in each compartment.

EXAMPLE

The following comparative tests were conducted to show the utility of the present invention. Three solid blending methods were examined. In all the tests a 20 cp gelatin was used which was adjusted with dye to produce absorbencies of 0.0 (no dye), 0.33, 0.67 and 1.0 to simulate four emulsion batches. This simulated test resulted in higher batch-to-batch variability than in production to allow greater testing resolution.

Three solid blending methods were examined:

1) Solid Blending: The four batches were quick chilled to produce ½" cube chunks, then mixed in a solids blender in equal quantities. The mixture was added directly to the hopper.
2) Compartment Blending: The hopper was separated into four equal area compartments by dividers as shown in FIGS. 1 and 2. The dividers were located based on coil design to produce equal melting between compartments. Each compartment was then filled with gelatin of a different batch.
3) Random Blending: The dividers were removed and gelatin was placed in the hopper, one from each batch in order of increasing absorbance until the hopper was full. The selection of batch was ordered, but the gelatin was allowed to fall into the hopper randomly.

The output of the liquefier was maintained at 1 liter/-min for all experiments. For best results a 10 liter surge tank was included after the passive liquefier of the present invention. Concentration variability with a 10 liter surge tank was as shown in Table 1.

TABLE 1

| METHOD | SOLID BLENDING 1 | COMPARTMENT BLENDING 2 | RANDOM BLENDING 3 |
|---|---|---|---|
| Relative Standard Deviation | 0.45% | 2.2% | 16% |

These results show that the compartment blending (2) works very well in comparison to the solid blending (1). The solid blending was at level of the instrument noise. The coil segments of equal area produce approximately equal melting rates. Thus, the present invention is a method and apparatus for achieving blending and melting of solid material in one unit operation.

In practice, the reservoir volume can be any size, but is typically optimized to provide minimum hold-up and thereby prevent melt drift and maximize blend uniformity while not interfering with the ultrasonic deaeration capability. For the present invention currently in use, a volume of 20 liters is used. The shape of the reservoir is based on fundamental mixing technology with a maximum width to height ratio of 2 to 1. The blended material is then passed through the deaeration device shown and supplied to the coating delivery system.

It is to be understood that the foregoing detailed description, while indicating preferred embodiments of the present invention, are given by way of illustration and not limitation. Many changes and modifications within the scope of the present invention may be made without departing from the spirit thereof and the invention includes all such modifications.

What is claimed is:

1. An apparatus for processing a plurality of meltable solid components comprising:

a hopper having an upper section for receiving the plurality of meltable solid components, the upper section being divided into a plurality of compartments by walls, wherein each of said plurality of compartments divides a first cross section of the upper section of the hopper into an area, and the hopper having a lower section for storing liquid;

a coiled tube disposed at a second cross section of said hopper for supporting and melting the meltable solid components into a liquid, the second cross section having a coiled tube surface area wherein the plurality of compartments divides the second cross section into a plurality of compartment coiled surface areas;

a mixer for agitating the liquid in said lower section at a rate which minimizes air entrainment;

liquid removal means for removing liquid from the lower section;

heating means for supplying heat to said coiled tube for melting the plurality of solid components wherein when the plurality of meltable solid components are loaded into the plurality of compartments, a melting rate of one of said plurality of solid components is proportional to an overall melting rate based on one of said compartment coiled surface areas and the coiled tube surface area.

2. The apparatus according to claim 1 further comprising a debubbler disposed in said lower section wherein said liquid is debubbled prior to removal.

3. A method of processing a plurality of meltable solid components comprising:

a) providing a hopper divided into a plurality of compartments, each of said plurality of compartments divides a hopper cross section into a plurality of compartment areas;

b) feeding a plurality of meltable solid components into the plurality of compartments;

c) supporting the plurality of meltable solid components on a coiled tube at the cross section having a coiled tube surface area wherein said plurality of compartments divides the cross section into a plurality of compartment coiled surface areas;

d) providing heat to the coiled tube such that the plurality of meltable solid components are melted to a liquid at a rate which is approximately proportional to an overall melting rate based on one of said compartment coiled surface areas and the coiled tube surface area;

e) collecting the liquid;

f) mixing the liquid at a rate such that air entrainment is minimized.

4. The method according to claim 3 wherein the plurality of meltable solid components are photographic emulsions.

* * * * *